US010510312B2

(12) United States Patent
Sim et al.

(10) Patent No.: US 10,510,312 B2
(45) Date of Patent: Dec. 17, 2019

(54) GATE DRIVER, DISPLAY APPARATUS INCLUDING THE SAME AND METHOD OF DRIVING DISPLAY PANEL USING THE SAME

(71) Applicant: Samsung Display Co., LTD., Yongin, Gyeonggi-Do (KR)

(72) Inventors: Jong-Hyun Sim, Busan (KR); Neung-Beom Lee, Asan-si (KR); Dong-Joon Kwag, Ansan-si (KR); Soo-Yeon Kim, Yongin-si (KR); Jeong-Hyun Kim, Cheonan-si (KR); Hyeon-Uk Won, Suwon-si (KR); Ji-Ye Lee, Cheonan-si (KR); Hyeon-Woo Hwang, Incheon (KR)

(73) Assignee: Samsung Display Co., Ltd. (KR)

( * ) Notice: Subject to any disclaimer, the term of this patent is extended or adjusted under 35 U.S.C. 154(b) by 588 days.

(21) Appl. No.: 14/805,290

(22) Filed: Jul. 21, 2015

(65) Prior Publication Data

US 2016/0042713 A1 Feb. 11, 2016

(30) Foreign Application Priority Data

Aug. 5, 2014 (KR) ..... 10-2014-0100607

(51) Int. Cl.
*G09G 3/36* (2006.01)

(52) U.S. Cl.
CPC ... *G09G 3/3674* (2013.01); *G09G 2310/0286* (2013.01); *G09G 2320/0219* (2013.01); *G09G 2320/0223* (2013.01)

(58) Field of Classification Search
None
See application file for complete search history.

(56) References Cited

U.S. PATENT DOCUMENTS

| | | | | |
|---|---|---|---|---|
| 2008/0111933 | A1 | 5/2008 | Lee et al. | |
| 2008/0136809 | A1* | 6/2008 | Lee | G09G 3/3677 345/214 |
| 2008/0303765 | A1* | 12/2008 | Nakatsuka | G09G 3/3648 345/87 |
| 2011/0157132 | A1* | 6/2011 | Byun | G09G 3/3677 345/211 |

FOREIGN PATENT DOCUMENTS

| | | |
|---|---|---|
| KR | 10-2003-0068632 | 8/2003 |
| KR | 10-2003-0084301 | 11/2003 |
| KR | 10-2004-0013605 | 2/2004 |
| KR | 10-2006-0062645 | 6/2006 |
| KR | 10-2006-0104210 | 10/2006 |
| KR | 10-2007-0072763 | 7/2007 |

* cited by examiner

*Primary Examiner* — Amare Mengistu
*Assistant Examiner* — Sarvesh J Nadkarni
(74) *Attorney, Agent, or Firm* — Innovation Counsel LLP

(57) ABSTRACT

A gate driver includes a gate signal generating part, a switching part and a switching controlling part. The gate signal generating part is configured to generate a gate signal including a precharge time and a normal charge time using a compensated gate on voltage and a gate off voltage. The switching part is disposed between the gate signal generating part and a gate line. The switching part is configured to apply a compensated gate signal to the gate line. The switching controlling part is configured to generate a switching control signal for controlling an operation of the switching part.

3 Claims, 6 Drawing Sheets

GATE DRIVER, DISPLAY APPARATUS INCLUDING THE SAME AND METHOD OF DRIVING DISPLAY PANEL USING THE SAME

CROSS-REFERENCE TO RELATED APPLICATIONS

This application claims priority under 35 U.S.C. § 119 to Korean Patent Application No. 10-2014-0100607, filed on Aug. 5, 2014 in the Korean Intellectual Property Office KIPO, the contents of which are herein incorporated by reference in their entireties.

BACKGROUND

1. Field

Exemplary embodiments of the present inventive concept relate to a gate driver, a display apparatus including the gate driver and a method of driving a display panel using the gate driver. More particularly, exemplary embodiments of the present inventive concept relate to a gate driver improving a charging rate of a pixel voltage and reducing a power consumption of a display apparatus, a display apparatus including the gate driver and a method of driving a display panel using the gate driver.

2. Description of the Related Art

Generally, a liquid crystal display ("LCD") apparatus includes a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

Generally, a display apparatus includes a display panel and a panel driver. The display panel includes a plurality of gate lines and a plurality of data lines. The panel driver includes a gate driver providing gate signals to the gate lines and a data driver providing data voltages to the data lines.

In the liquid crystal display apparatus, a kick back voltage may be generated due to a difference between a gate on voltage and a gate off voltage which are used to generate a gate signal. Due to the kick back voltage, a display quality of the display panel may decrease.

SUMMARY

Exemplary embodiments of the present inventive concept provide a gate driver decreasing a kick back voltage by a charge sharing of a gate on voltage, improving a charging rate of a pixel voltage and reducing a power consumption of the display apparatus by selectively applying the charge sharing in a normal charge time and in a precharge time.

Exemplary embodiments of the present inventive concept also provide a display apparatus including the gate driver.

Exemplary embodiments of the present inventive concept also provide a method of driving a display panel using the gate driver.

In an exemplary embodiment of a gate driver according to the present inventive concept, the gate driver includes a gate signal generating part, a switching part and a switching controlling part. The gate signal generating part is configured to generate a gate signal including a precharge time and a normal charge time using a compensated gate on voltage and a gate off voltage. The switching part is disposed between the gate signal generating part and a gate line. The switching part is configured to apply a compensated gate signal to the gate line. The switching controlling part is configured to generate a switching control signal for controlling an operation of the switching part.

In an exemplary embodiment, the switching part may be configured to prevent a voltage drop of the compensated gate on voltage from being applied to the compensated gate signal in the precharge time. The switching part may be configured to allow the voltage drop of the compensated gate on voltage to be applied to the compensated gate signal in the normal charge time.

In an exemplary embodiment, the switching part may include a first switch and a first diode connected in parallel between the gate signal generating part and the gate line.

In an exemplary embodiment, the switching control signal may be generated using a previous gate clock signal corresponding to a previous gate line, a present gate clock signal corresponding to a present gate line and a kick back compensation signal.

In an exemplary embodiment, the switching controlling part may include AND gate configured to receive the previous gate clock signal, the present gate clock signal and the kick back compensation signal.

In an exemplary embodiment, the switching controlling part may include a shift register configured to receive a vertical start signal and a kick back compensation signal.

In an exemplary embodiment, the switching part may include a first diode and a path selector configured to connect one of first and second gate lines to the first diode.

In an exemplary embodiment, the path selector may include a first switch disposed between the gate signal generating part and the first diode and a second switch disposed between the first diode and the first gate line.

In an exemplary embodiment, the compensated gate on voltage may have a gate on voltage level which is a DC voltage and may gradually decrease from the gate on voltage level corresponding to a kick back compensation signal.

In an exemplary embodiment of a display apparatus according to the present inventive concept, the display apparatus includes a display panel, a power voltage generator, a gate driver and a data driver. The display panel includes a gate line and a data line. The display panel is configured to display an image. The power voltage generator is configured to generate a compensated gate on voltage and a gate off voltage. The gate driver includes a gate signal generating part configured to generate a gate signal including a precharge time and a normal charge time using the compensated gate on voltage and the gate off voltage, a switching part disposed between the gate signal generating part and the gate line and configured to apply a compensated gate signal to the gate line and a switching controlling part configured to generate a switching control signal for controlling an operation of the switching part. The data driver is configured to generate a data voltage and to apply the data voltage to the data line.

In an exemplary embodiment, the switching part may be configured to prevent a voltage drop of the compensated gate on voltage from being applied to the compensated gate signal in the precharge time. The switching part may be configured to allow the voltage drop of the compensated gate on voltage to be applied to the compensated gate signal in the normal charge time.

In an exemplary embodiment, the switching part may include a first switch and a first diode connected in parallel between the gate signal generating part and the gate line.

In an exemplary embodiment, the switching part may include a first diode and a path selector configured to connect one of first and second gate lines to the first diode.

In an exemplary embodiment, the compensated gate on voltage may have a gate on voltage level which is a DC voltage and may gradually decrease from the gate on voltage level corresponding to a kick back compensation signal.

In an exemplary embodiment, the power voltage generator may include a first transistor comprising a control electrode to which a first kick back compensation signal is applied, an input electrode to which the gate on voltage is applied and an output electrode connected to an output terminal which outputs the compensated gate on voltage and a second transistor comprising a control electrode to which a second kick back compensation signal is applied, an input electrode connected to the output terminal and an output electrode to which a kick back low voltage having a kick back compensation voltage less than the gate on voltage is applied, wherein the first kick back compensation signal is an inverted signal of the second kick back compensation signal.

In an exemplary embodiment of a method of driving a display panel according to the present inventive concept, the method includes generating a compensated gate on voltage and a gate off voltage, generating a gate signal including a precharge time and a normal charge time using the compensated gate on voltage and the gate off voltage, applying a compensated gate signal to a gate line using a switching part disposed between a gate signal generating part and the gate line and generating a data voltage and applying the data voltage to the data line.

In an exemplary embodiment, the switching part may be configured to prevent a voltage drop of the compensated gate on voltage from being applied to the compensated gate signal in the precharge time. The switching part may be configured to allow the voltage drop of the compensated gate on voltage to be applied to the compensated gate signal in the normal charge time.

In an exemplary embodiment, the compensated gate on voltage may have a gate on voltage level which is a DC voltage and may gradually decrease from the gate on voltage level corresponding to a kick back compensation signal.

According to the gate driver, the display apparatus including the gate driver and the method of driving the display panel using the gate driver, the display apparatus includes the power voltage generator applies a charge sharing to a gate on voltage so that the kick back voltage may decrease and the display quality may be improved. In addition, the display apparatus includes the gate driver which prevents the charge sharing in in the precharge time so that the charging rate of the pixel voltage may be improved and the power consumption may be reduced.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
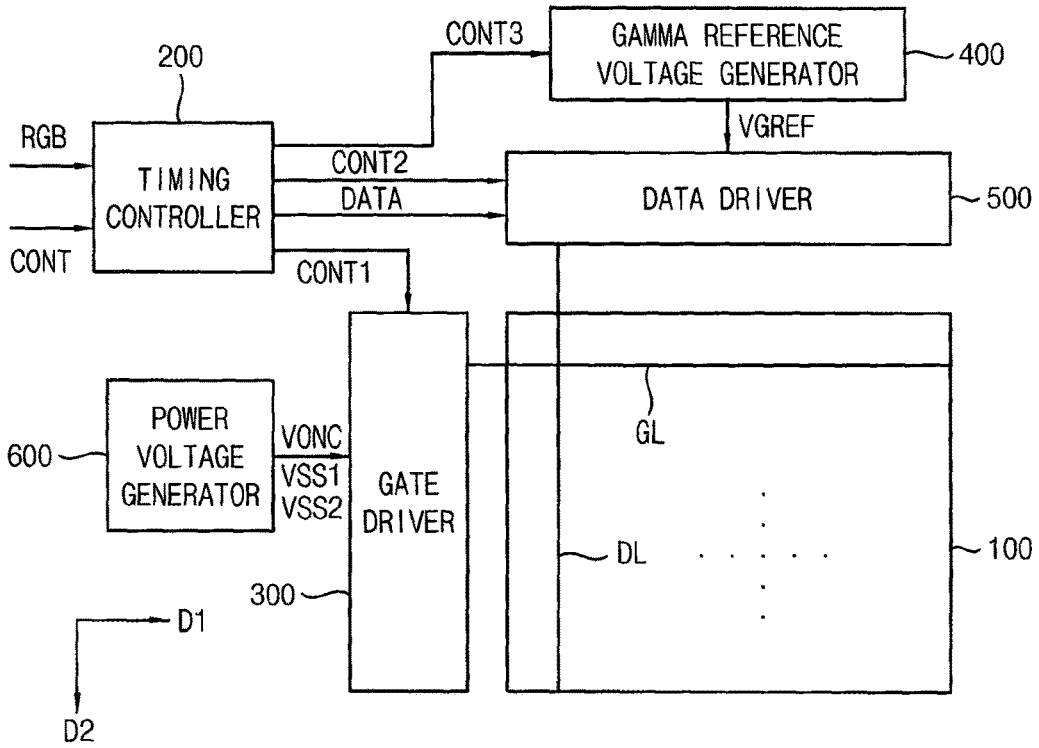
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, a data driver 500 and a power voltage generator 600.

The display panel 100 displays an image. The display panel 100 has a display region on which an image is displayed and a peripheral region surrounding the display region.

The display panel 100 includes a plurality of gate lines GL, a plurality of data lines DL and a plurality of unit pixels connected to the gate lines GL and the data lines DL. The gate lines GL extend in a first direction D1 and the data lines DL extend in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels may be disposed in a matrix form.

The timing controller 200 receives input image data RGB and an input control signal CONT from an external apparatus (not shown). The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates compensated gate signals driving the gate lines GL in response to the first control signal CONT1 received from the timing controller 200. The gate driver 300 sequentially outputs the compensated gate signals to the gate lines GL.

The compensated gate signals do not have a voltage drop during a kick back compensation period in a precharge time but have a voltage drop during a kick back compensation period in a normal charge time.

The gate driver 300 may be directly mounted on the display panel 100, or may be connected to the display panel 100 as a tape carrier package (TCP) or chip-on-glass (COG). Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200 or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

For example, the data driver 500 may be connected to the display panel 100 as a TCP or COG Alternatively, the data driver 500 may be integrated on the peripheral region of the display panel 100.

The power voltage generator 600 generates a compensated gate on voltage VONC and a gate off voltage. The power voltage generator 600 outputs the compensated gate on voltage VONC and the gate off voltage to the gate driver 300. The gate off voltage may includes a first gate off voltage VSS1 and a second gate off voltage VSS2 lower than the first gate off voltage VSS1.

Figure 2:
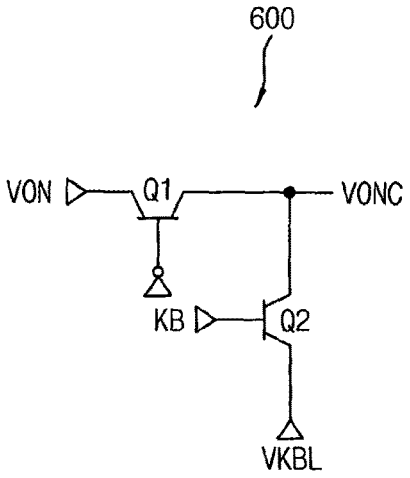
FIG. 2 is a circuit diagram illustrating a power voltage generator of FIG. 1.
Figure 3:
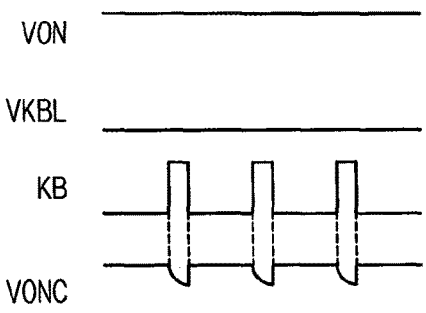
FIG. 3 is a waveform diagram illustrating input and output signals of the power voltage generator of FIG. 2.

FIG. 2 is a circuit diagram illustrating a power voltage generator 600 of FIG. 1. FIG. 3 is a waveform diagram illustrating input and output signals of the power voltage generator 600 of FIG. 2.

Referring to FIGS. 1 to 3, the power voltage generator 600 generates the compensated gate on voltage VONC and outputs the compensated gate on voltage VONC to the gate driver 300. The power voltage generator 600 may generate the compensated gate on voltage VONC based on a gate on voltage VON having a gate on level, a kick back low voltage VKBL having a level less than the gate on level and a kick back compensation signal KB. Herein the gate on level is a DC level.

When the kick back compensation signal KB has a low level, the compensated gate on voltage VONC has the gate on level. When the kick back compensation signal KB has a high level, the compensated gate on voltage VONC gradually decrease from the gate on level to the level of the kick back low voltage VKBL.

By using the compensated gate on voltage VONC, when the gate signal (or the compensated gate signal) decreases from a high level to a low level, the level of the gate signal (or the compensated gate signal) is not suddenly dropped from the high level to the low level so that the kick back voltage of the display panel 100 may decrease. Thus, the display quality of the display panel 100 may be improved.

The power voltage generator 600 may include a first switching element Q1 and a second switching element Q2. The kick back compensation signal KB is commonly applied to control electrodes of the first switching element Q1 and the second switching element Q2. For example, the first switching element Q1 is a first transistor. The second switching element Q2 is a second transistor. An inverter may be connected between the kick back compensation signal KB and a control electrode of the first switching element Q1 to invert the kick back compensation signal so that an inverted kick back compensation signal KB_Bar may be applied to the gate of the first switching element Q1. Instead, the inverter may be connected between the kick back compensation signal KB and a control electrode of the second switching element Q1 so that an inverted kick back compensation signal KB_Bar may be applied to the gate of the second switching element Q1.

The first switching element Q1 may include the control electrode to which the kick back compensation signal KB is applied, an input electrode to which the gate on voltage VON is applied and an output electrode connected to an output terminal of the power voltage generator 600. The output terminal of the power voltage generator 600 outputs the compensated gate on voltage VONC.

The second switching element Q2 may include the control electrode to which the kick back compensation signal KB is applied, an input electrode connected to an output terminal of the power voltage generator 600 and an output electrode to which the kick back low voltage VKBL having a kick back compensation level less than the gate on level is applied.

Figure 4:
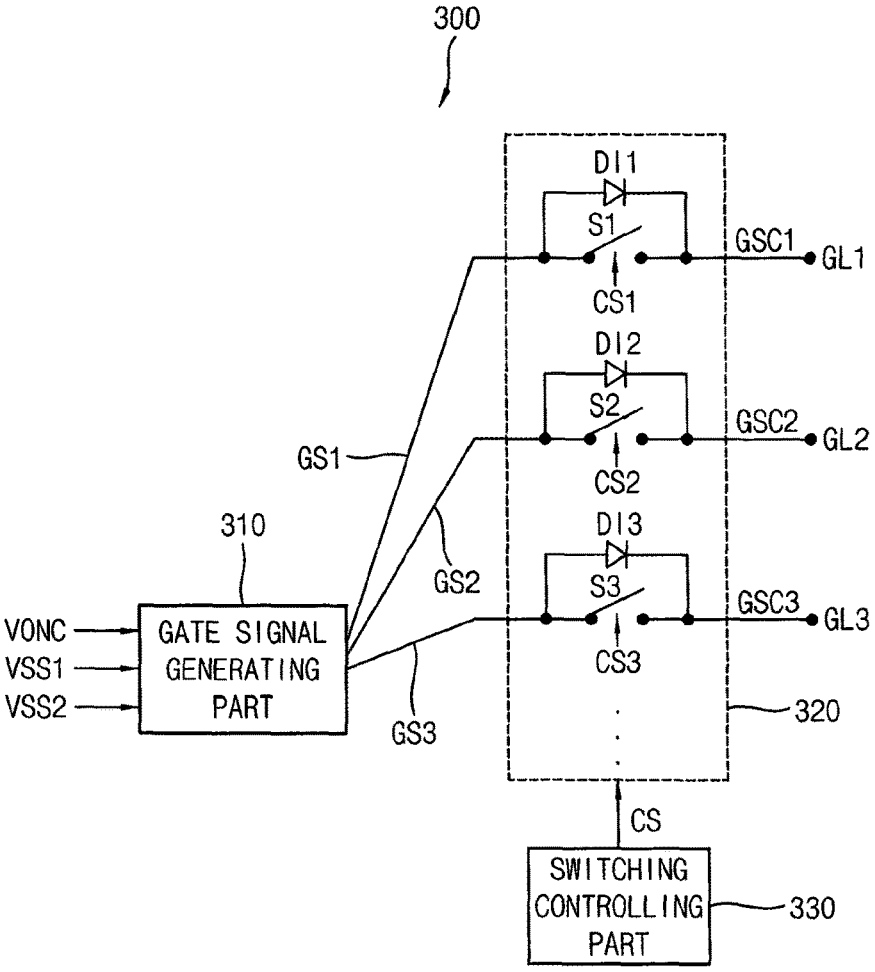
FIG. 4 is a block diagram illustrating a gate driver of FIG. 1.
Figure 5:
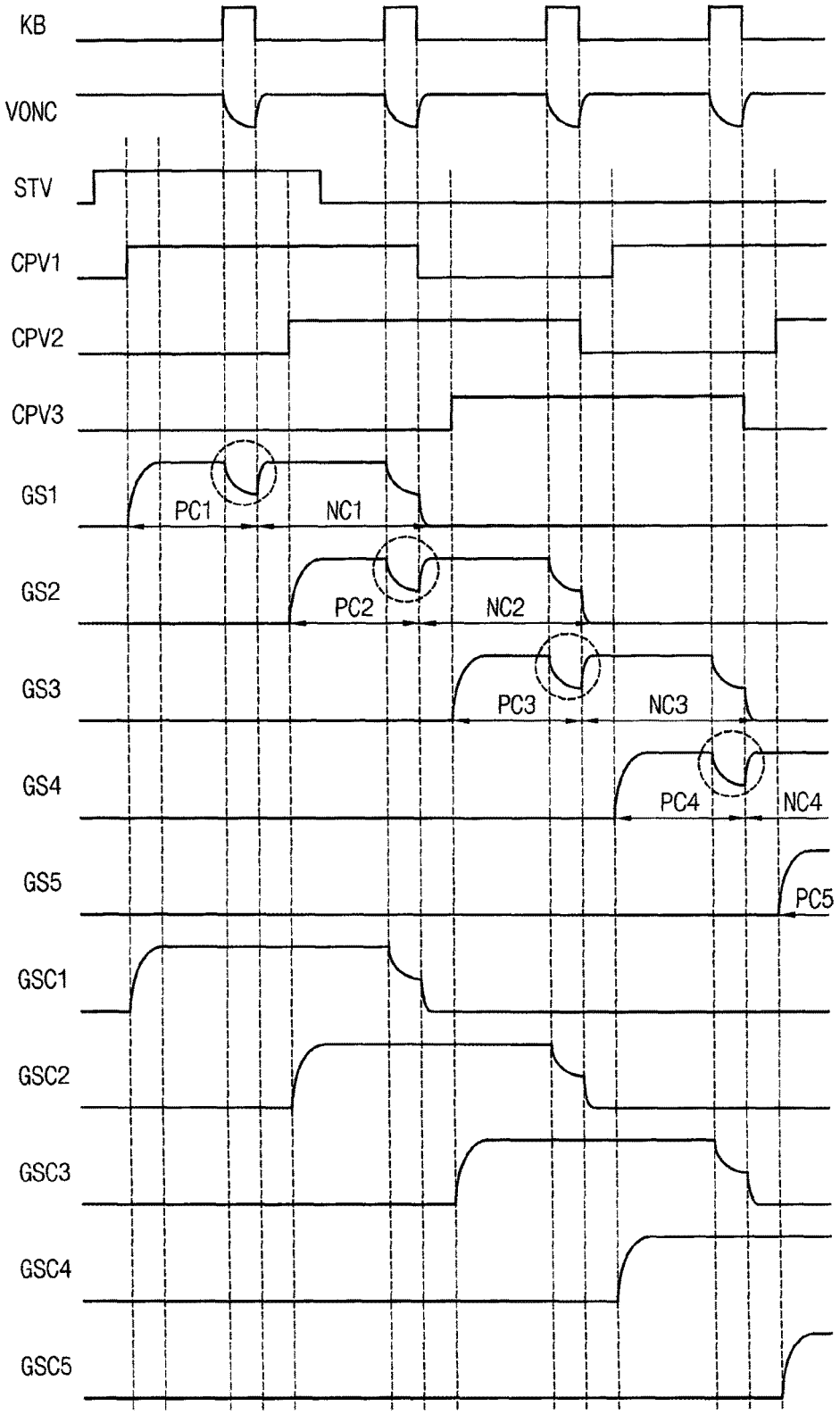
FIG. 5 is a waveform diagram illustrating input and output signals of the gate driver of FIG. 1.
Figure 6:
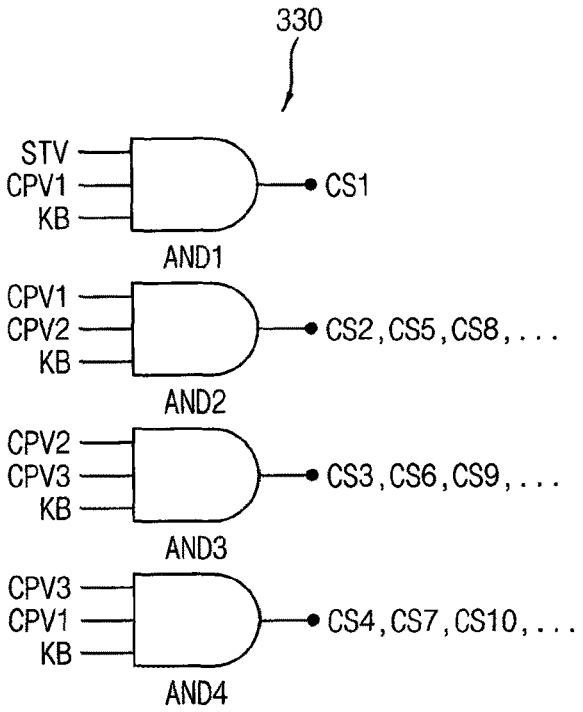
FIG. 6 is a circuit diagram illustrating a switching controlling part of FIG. 4.

FIG. 4 is a block diagram illustrating the gate driver 300 of FIG. 1. FIG. 5 is a waveform diagram illustrating input and output signals of the gate driver 300 of FIG. 1. FIG. 6 is a circuit diagram illustrating a switching controlling part 330 of FIG. 4.

Referring to FIGS. 1 to 6, the gate driver 300 includes a gate signal generating part 310, a switching part 320 and a switching controlling part 330.

The gate signal generating part 310 generates a gate signals GS1, GS2 and GS3 including a precharge time and a normal charge time using the compensated gate on voltage VONC and the gate off voltage VSS1 and VSS2.

The switching part 320 is disposed between the gate signal generating part 310 and the gate lines GL1, GL2 and GL3. The switching part 320 applies the compensated gate signal GSC1, GSC2 and GSC3 to the gate line GL1, GL2 and GL3.

The switching part 320 prevents a voltage drop of the compensated gate on voltage VONC in the precharge time PC1, PC2 and PC3 and allows the voltage drop of the compensated gate on voltage VONC in the normal charge time NC1, NC2 and NC3.

In the present exemplary embodiment, the switching part 320 includes a diode DI1, DI2 and DI3 and a switch S1, S2 and S3 connected to each other in parallel. The diode DI1, DI2 and DI3 and the switch S1, S2 and S3 are connected to the gate line GL1, GL2 and GL3, respectively. The switch S1, S2 and S3 of the switching part 320 is turned on and off according to the switching control signal CS1, CS2 and CS3.

For example, the switching part 320 includes a first switch S1 and a first diode DI1 connected between the first gate line GL1 and the gate signal generating part. The first switch S1 and the first diode DI1 are connected in parallel between the first gate line GL1 and the gate signal generating part. The switching part 320 includes a second switch S2 and a second diode DI2 connected in parallel between the second gate line GL2 and the gate signal generating part. The switching part 320 includes a third switch S3 and a third diode DI3 connected in parallel between the third gate line GL3 and the gate signal generating part.

The switching controlling part 330 generates the switching control signal CS1, CS2 and CS3 for controlling an operation of the switching part 320.

In the present exemplary embodiment, the switching control signals CS1, CS2 and CS3 are generated using a previous gate clock signal corresponding to a previous gate line, a present gate clock signal corresponding to a present gate line and the kick back compensation signal KB. The switching control signal CS1, CS2 and CS3 may have a high level when all of the previous clock signal, the present clock signal and the kick back compensation signal KB have high levels.

For example, a first switching control signal CS1 applied to the first switch S1 connected to the first gate line GL1 may be generated using a vertical start signal STV, a first gate clock signal CPV1 and the kick back compensation signal KB. Because there is no previous clock signal for the first gate line, the vertical start signal STV may be used instead of the previous clock signal for a first row. The first switching control signal CS1 may have a high level when all of the vertical start signal STV, the first gate clock signal CPV1 and the kick back compensation signal KB have high levels.

For example, a second switching control signal CS2 applied to the second switch S2 connected to the second gate line GL2 may be generated using the first gate clock signal CPV1, a second gate clock signal CPV2 and the kick back compensation signal KB. The second switching control signal CS2 may have a high level when all of the first gate clock signal CPV1, the second gate clock signal CPV2 and the kick back compensation signal KB have high levels. A fifth switching control signal CS5 applied to a fifth switch S5 connected to a fifth gate line GL5 may be substantially the same as the second control signal CS2. An eighth switching control signal CS8 applied to an eighth switch S8 connected to an eighth gate line GL8 may be substantially the same as the second control signal CS2.

For example, a third switching control signal CS3 applied to the third switch S3 connected to the third gate line GL3 may be generated using the second gate clock signal CPV2, a third gate clock signal CPV3 and the kick back compensation signal KB. The third switching control signal CS3 may have a high level when all of the second gate clock signal CPV2, the third gate clock signal CPV3 and the kick back compensation signal KB have high levels. A sixth switching control signal CS6 applied to a sixth switch S6 connected to a sixth gate line GL6 may be substantially the same as the third control signal CS3. A ninth switching control signal CS9 applied to a ninth switch S9 connected to a ninth gate line GL9 may be substantially the same as the third control signal CS3.

For example, a fourth switching control signal CS4 applied to the fourth switch S4 connected to the fourth gate line GL4 may be generated using the third gate clock signal CPV3, the first gate clock signal CPV1 and the kick back compensation signal KB. The fourth switching control signal CS4 may have a high level when all of the third gate clock signal CPV3, the first gate clock signal CPV1 and the kick back compensation signal KB have high levels. A seventh switching control signal CS7 applied to a seventh switch S7 connected to a seventh gate line GL7 may be substantially the same as the fourth control signal CS4. A tenth switching control signal CS10 applied to a tenth switch S10 connected to a tenth gate line GL10 may be substantially the same as the fourth control signal CS4.

For example, the switching controlling part 330 may include AND gate receiving the previous gate clock signal, the present gate clock signal and the kick back compensation signal KB as shown in FIG. 6.

As shown in FIG. 5, a waveform of the compensated gate on voltage VONC is partially dropped corresponding to the kick back compensation signal KB. Due to the voltage drop of the compensated gate on voltage VONC, the gate signals GS1, GS2, GS3, GS4 and GS5) are not suddenly dropped so that the kick back voltage decreases.

When the voltage drop of the compensated gate on voltage VONC is applied to ending portions of the normal charge time NC1, NC2, NC3, NC4 and NC5 of the gate signals GS1, GS2, GS3, GS4 and GS5, the kick back voltage may effectively decrease.

In contrast, the voltage drop of the compensated gate on voltage VONC is not required to be applied during the precharge time PC1, PC2, PC3, PC4 and PC5 of the of the gate signals GS1, GS2, GS3, GS4 and GS5. When the voltage drop of the compensated gate on voltage VONC is applied during the precharge time PC1, PC2, PC3, PC4 and PC5 of the of the gate signals GS1, GS2, GS3, GS4 and GS5, charging rate of the precharge time PC1, PC2, PC3, PC4 and PC5 decreases so that the efficiency of the precharge may be decreases due to the voltage drop.

Thus, the voltage drop of the compensated gate on voltage VONC is preferable to be applied to the normal charge time NC1, NC2, NC3, NC4 and NC5 and is preferable not to be applied to the precharge time PC1, PC2, PC3, PC4 and PC5.

The switching part 320 prevents a voltage drop of the compensated gate on voltage VONC from being applied to the compensated gate signal GSC1, GSC2, GSC3, GSC4 and GSC5 in the precharge time PC1, PC2, PC3, PC4 and PC5 and allows the voltage drop of the compensated gate on voltage VONC to be applied to the compensated gate signal GSC1, GSC2, GSC3, GSC4 and GSC5 in the normal charge time NC1, NC2, NC3, NC4 and NC5.

For example, all of the vertical start signal STV, the first gate clock signal CPV1 and the kick back compensation signal KB have high levels when the kick back compensation signal KB is a high level in the first precharge time PC1, so that the first switching control signal CS1 has a high level. Accordingly, the first switch S1 is turned off and a current flow from the first gate line GL1 to the gate signal generating part 310 is cut off by the first diode DI1. Thus, the voltage drop of the first compensated gate signal GSC1 applied to the first gate line GL1 is prevented when the kick back compensation signal KB is a high level in the first precharge time PC1.

In contrast, at least one of the vertical start signal STV, the first gate clock signal CPV1 and the kick back compensation signal KB does not have high levels when the kick back compensation signal KB is a high level in the first normal charge time NC1, so that the first switching control signal CS1 has a low level. Accordingly, the first switch S1 is turned on and a current flow from the first gate line GL1 to the gate signal generating part 310 is not cut off by the first diode DI1. Thus, the level drop of the first compensated gate signal GSC1 applied to the first gate line GL1 is allowed when the kick back compensation signal KB is a high level in the first normal time NC1.

For example, in a similar manner, all of the first gate clock signal CPV1, the second gate clock signal CPV2 and the kick back compensation signal KB have high levels when the kick back compensation signal KB is a high level in the second precharge time PC2, so that the second switching control signal CS2 has a high level. Accordingly, the second switch S2 is turned off and a current flow from the second gate line GL2 to the gate signal generating part 310 is cut off by the second diode DI2. Thus, the level drop of the second compensated gate signal GSC2 applied to the second gate line GL2 is prevented when the kick back compensation signal KB is a high level in the second precharge time PC2.

In contrast, at least one of the first gate clock signal CPV1, the second gate clock signal CPV2 and the kick back compensation signal KB does not have high levels when the kick back compensation signal KB is a high level in the second normal charge time NC2, so that the second switching control signal CS2 has a low level. Accordingly, the second switch S2 is turned on and a current flow from the second gate line GL2 to the gate signal generating part 310 is not cut off by the second diode DI2. Thus, the voltage drop of the second compensated gate signal GSC2 applied to the second gate line GL2 is allowed when the kick back compensation signal KB is a high level in the second normal time NC2.

According to the present exemplary embodiment, the power voltage generator 600 generates the compensated gate on voltage VONC by applying the charge sharing to the gate on voltage VON so that the kick back voltage may decrease and the display quality of the display panel 100 may be improved.

In addition, the switching part 320 prevents a voltage drop of the compensated gate on voltage VONC from being applied to the compensated gate signal GSC1, GSC2, GSC3, GSC4 and GSC5 in the precharge time PC1, PC2, PC3, PC4 and PC5 and allows the voltage drop of the compensated gate on voltage VONC to be applied to the compensated gate signal GSC1, GSC2, GSC3, GSC4 and GSC5 in the normal charge time NC1, NC2, NC3, NC4 and NC5 so that the charging rate of the pixel voltage may be improved and the power consumption may be reduced.

Figure 7:
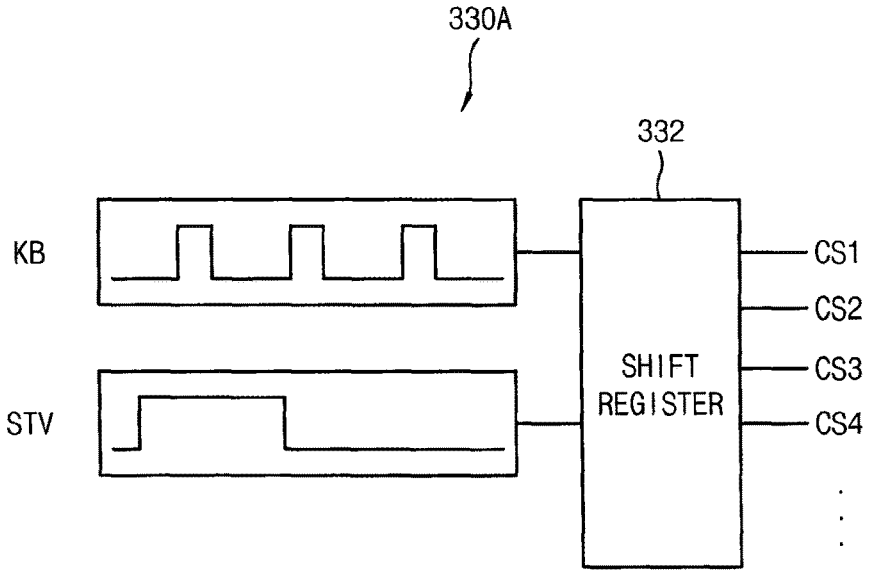
FIG. 7 is a block diagram illustrating a switching controlling part according to an exemplary embodiment of the present inventive concept.

FIG. 7 is a block diagram illustrating a switching controlling part according to another exemplary embodiment of the present inventive concept.

The display apparatus and the method of driving the display panel using the display apparatus are substantially the same as the display apparatus and the method of driving the display panel using the display apparatus of the previous exemplary embodiment explained referring to FIGS. 1 to 6 except for the structure and the operation of the switching controlling part. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 5 and 7, the display apparatus includes a display panel 100 and a panel driver. The panel driver includes a timing controller 200, a gate driver 300, a gamma reference voltage generator 400, a data driver 500 and a power voltage generator 600.

The power voltage generator 600 generates a compensated gate on voltage VONC and outputs the compensated gate on voltage VONC to the gate driver 300. The power voltage generator 600 may generate the compensated gate on voltage VONC based on a gate on voltage VON having a gate on level, a kick back low voltage VKBL having a level less than the gate on level and a kick back compensation signal KB.

The gate driver 300 includes a gate signal generating part 310, a switching part 320 and a switching controlling part 330A.

The gate signal generating part 310 generates a gate signal GS1, GS2 and GS3 including a precharge time and a normal charge time using the compensated gate on voltage VONC and the gate off voltage VSS1 and VSS2.

The switching part 320 is disposed between the gate signal generating part 310 and the gate lines GL1, GL2 and GL3. The switching part 320 applies the compensated gate signal GSC1, GSC2 and GSC3 to the gate line GL1, GL2 and GL3.

The switching part 320 prevents a voltage drop of the compensated gate on voltage VONC from being applied to the compensated gate signal GSC1, GSC2 and GSC3 in the precharge time PC1, PC2 and PC3 and allows the voltage drop of the compensated gate on voltage VONC to be applied to the compensated gate signal GSC1, GSC2 and GSC3 in the normal charge time NC1, NC2 and NC3.

The switching controlling part 330A generates the switching control signal CS1, CS2, CS3 and CS4 for controlling an operation of the switching part 320.

In the present exemplary embodiment, the switching control signals CS1, CS2, CS3 and CS4 are generated using a vertical start signal STV and the kick back compensation signal KB.

The switching controlling part 330A may include a shift register 332 receiving the vertical start signal STV and the kick back compensation signal KB.

For example, when the vertical start signal STV has a high level and the kick back compensation signal KB has a high level, the first switching control signal CS1 has a high level. The remaining switching control signals except for the first switching control signal CS1 have a low level.

When the kick back compensation signal KB has a next high level, the second switching control signal CS2 has a high level. The remaining switching control signals except for the second switching control signal CS2 have a low level.

When the kick back compensation signal KB has a next high level, the third switching control signal CS3 has a high level. The remaining switching control signals except for the third switching control signal CS3 have a low level.

As shown in FIG. 5, a waveform of the compensated gate on voltage VONC is partially dropped corresponding to the kick back compensation signal KB. Due to the voltage drop of the compensated gate on voltage VONC, the gate signals GS1, GS2, GS3, GS4 and GS5) are not suddenly dropped from the high lever to the low level so that the kick back voltage decreases.

When the voltage drop of the compensated gate on voltage VONC is applied to ending portions of the normal charge time NC1, NC2, NC3, NC4 and NC5 of the gate signals GS1, GS2, GS3, GS4 and GS5, the kick back voltage may effectively decrease.

In contrast, the voltage drop of the compensated gate on voltage VONC is not required to be applied during the precharge time PC1, PC2, PC3, PC4 and PC5 of the of the gate signals GS1, GS2, GS3, GS4 and GS5. When the voltage drop of the compensated gate on voltage VONC is applied during the precharge time PC1, PC2, PC3, PC4 and PC5 of the of the gate signals GS1, GS2, GS3, GS4 and GS5, charging rate of the precharge time PC1, PC2, PC3, PC4 and PC5 decreases so that the efficiency of the precharge decreases.

Thus, the voltage drop of the compensated gate on voltage VONC is preferable to be applied to the normal charge time NC1, NC2, NC3, NC4 and NC5 and is preferable not to be applied to the precharge time PC1, PC2, PC3, PC4 and PC5.

The switching part 320 prevents a voltage drop of the compensated gate on voltage VONC from being applied to the compensated gate signal GSC1, GSC2, GSC3, GSC4 and GSC5 in the precharge time PC1, PC2, PC3, PC4 and PC5 and allows the voltage drop of the compensated gate on voltage VONC to be applied to the compensated gate signal GSC1, GSC2, GSC3, GSC4 and GSC5 in the normal charge time NC1, NC2, NC3, NC4 and NC5.

According to the present exemplary embodiment, the power voltage generator 600 generates the compensated gate on voltage VONC by applying the charge sharing to the gate on voltage VON so that the kick back voltage may decrease and the display quality of the display panel 100 may be improved.

In addition, the switching part 320 prevents a voltage drop of the compensated gate on voltage VONC from being applied to the compensated gate signal GSC1, GSC2, GSC3, GSC4 and GSC5 in the precharge time PC1, PC2, PC3, PC4 and PC5 and allows the voltage drop of the compensated gate on voltage VONC to be applied to the compensated gate signal GSC1, GSC2, GSC3, GSC4 and GSC5 in the normal charge time NC1, NC2, NC3, NC4 and NC5 so that the charging rate of the pixel voltage may be improved and the power consumption may be reduced.

Figure 8:
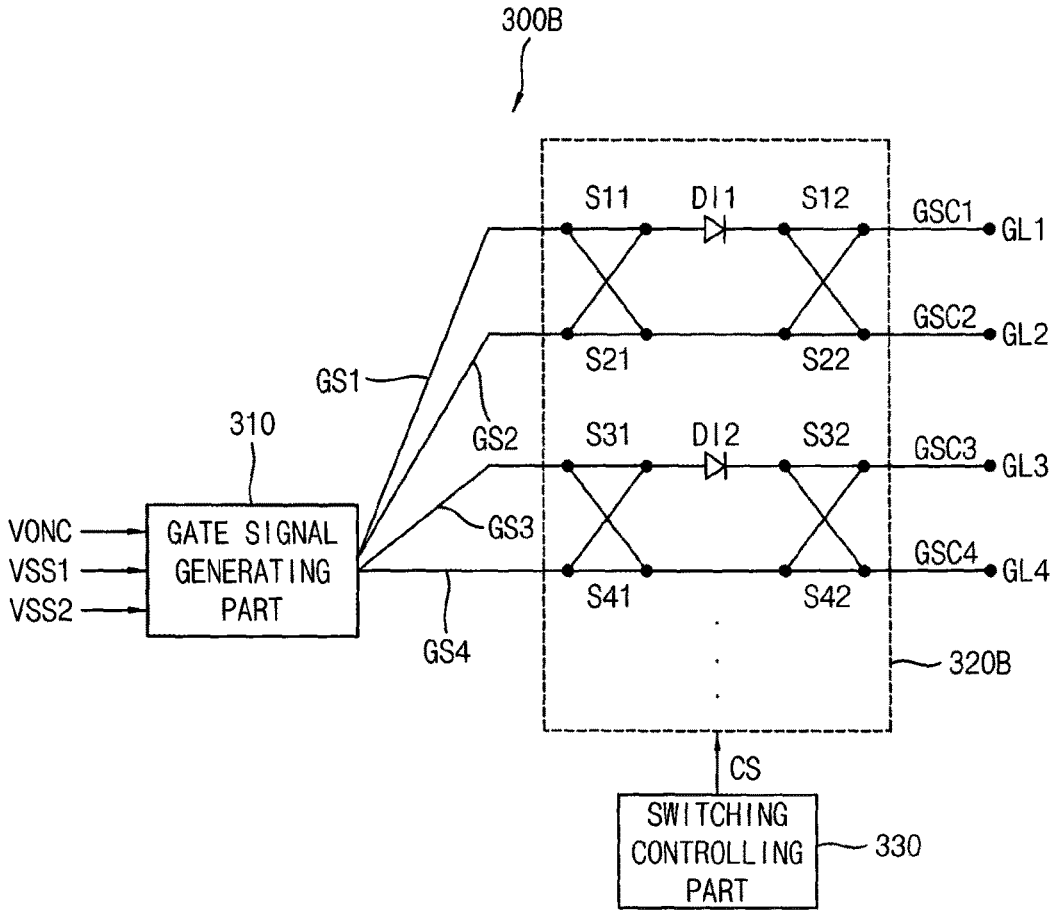
FIG. 8 is a block diagram illustrating a gate driver according to an exemplary embodiment of the present inventive concept.
Figure 9A:
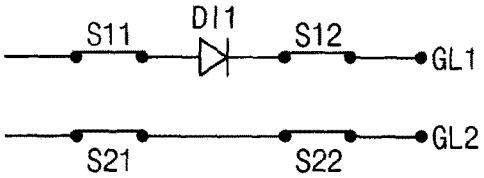
FIG. 9A is a circuit diagram illustrating a first status of a switching part of FIG. 8.
Figure 9B:
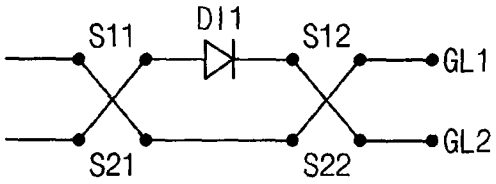
FIG. 9B is a circuit diagram illustrating a second status of a switching part of FIG. 8.

FIG. 8 is a block diagram illustrating a gate driver according to another exemplary embodiment of the present inventive concept. FIG. 9A is a circuit diagram illustrating a first status of a switching part 320B of FIG. 8. FIG. 9B is a circuit diagram illustrating a second status of a switching part 320B of FIG. 8.

The display apparatus and the method of driving the display panel using the display apparatus are substantially the same as the display apparatus and the method of driving the display panel using the display apparatus of the previous exemplary embodiment explained referring to FIGS. 1 to 6 except for the structure and the operation of the gate driver. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 3, 5, 8, 9A and 9B, the display apparatus includes a display panel 100 and a panel driver. The panel driver includes a timing controller 200, a gate driver 300, a gamma reference voltage generator 400, a data driver 500 and a power voltage generator 600.

The power voltage generator 600 generates a compensated gate on voltage VONC and outputs the compensated gate on voltage VONC to the gate driver 300. The power voltage generator 600 may generate the compensated gate on voltage VONC based on a gate on voltage VON having a gate on level, a kick back low voltage VKBL having a level lower than the gate on level and a kick back compensation signal KB.

The gate driver 300B includes a gate signal generating part 310, a switching part 320B and a switching controlling part 330.

The switching part 320B is disposed between the gate signal generating part 310 and the gate lines GL1, GL2, GL3 and GL4. The switching part 320B applies the compensated gate signal GSC1, GSC2, GSC3 and GSC4 to the gate line GL1, GL2, GL3 and GL4.

The switching part 320B prevents a voltage drop of the compensated gate on voltage VONC from being applied to the compensated gate signal GSC1, GSC2 and GSC3 in the precharge time PC1, PC2 and PC3 and allows the level drop of the compensated gate on voltage VONC to be applied to the compensated gate signal GSC1, GSC2 and GSC3 in the normal charge time NC1, NC2 and NC3.

In the present exemplary embodiment, the switching part 320B includes a diode and a path selector. The path selector connects one of two adjacent gate lines to the gate signal generating part 310 through a diode and connects the other of two adjacent gate lines to the gate signal generating part 310 directly.

For example, as shown in FIG. 9A, a first gate line GL1 is connected to the gate signal generating part 310 through a first diode DI1 by the path selector in a first status. A second gate line GL2 is directly connected to the signal generating part 310 by the path selector in the first status.

As shown in FIG. 9B, the first gate line GL1 is directly connected to the gate signal generating part 310 by the path selector in a second status. The second gate line GL2 is connected to the signal generating part 310 through the first diode DI1 by the path selector in the second status.

For example, the path selector may include a first switch S11 disposed between the gate signal generating part 310 and the first diode DI1 and a second switch S12 disposed between the first diode DI1 and the first gate line GL1.

For example, the path selector may include a third switch S21 disposed between the gate signal generating part 310 and the first diode DI1 and a fourth switch S22 disposed between the first diode DI1 and the second gate line GL2.

As shown in FIG. 5, a waveform of the compensated gate on voltage VONC is partially dropped corresponding to the kick back compensation signal KB. Due to the voltage drop of the compensated gate on voltage VONC, the gate signals GS1, GS2, GS3, GS4 and GS5) are not suddenly dropped so that the kick back voltage decreases.

When the voltage drop of the compensated gate on voltage VONC is applied to ending portions of the normal charge time NC1, NC2, NC3, NC4 and NC5 of the gate signals GS1, GS2, GS3, GS4 and GS5, the kick back voltage may effectively decrease.

In contrast, the voltage drop of the compensated gate on voltage VONC is not required to be applied during the precharge time PC1, PC2, PC3, PC4 and PC5 of the of the gate signals GS1, GS2, GS3, GS4 and GS5. When the voltage drop of the compensated gate on voltage VONC is applied during the precharge time PC1, PC2, PC3, PC4 and PC5 of the of the gate signals GS1, GS2, GS3, GS4 and GS5, charging rate of the precharge time PC1, PC2, PC3, PC4 and PC5 decreases so that the efficiency of the precharge decreases.

Thus, the voltage drop of the compensated gate on voltage VONC is preferable to be applied to the normal charge time NC1, NC2, NC3, NC4 and NC5 and is preferable not to be applied to the precharge time PC1, PC2, PC3, PC4 and PC5.

The switching part 320B prevents a voltage drop of the compensated gate on voltage VONC from being applied to the compensated gate signal GSC1, GSC2, GSC3, GSC4 and GSC5 in the precharge time PC1, PC2, PC3, PC4 and PC5 and allows the voltage drop of the compensated gate on voltage VONC to be applied to the compensated gate signal GSC1, GSC2, GSC3, GSC4 and GSC5 in the normal charge time NC1, NC2, NC3, NC4 and NC5.

For example, the first diode DI1 of the switching part 320B is connected to the first gate line GL1 when the kick back compensation signal KB is a high level in the first precharge time PC1. Accordingly, a current flow from the first gate line GL1 to the gate signal generating part 310 is cut off by the first diode DI1. Thus, the voltage drop of the first compensated gate signal GSC1 applied to the first gate line GL1 is prevented when the kick back compensation signal KB is a high level in the first precharge time PC1.

In contrast, the first gate line GL1 is directly connected to the gate signal generating part 310 when the kick back compensation signal KB is a high level in the first normal charge time NC1. Accordingly, a current flow from the first gate line GL1 to the gate signal generating part 310 is not cut off by the first diode DI1. Thus, the voltage drop of the first compensated gate signal GSC1 applied to the first gate line GL1 is allowed when the kick back compensation signal KB is a high level in the first normal time NC1.

For example, in a similar manner, the first diode DI1 of the switching part 320B is connected to the second gate line GL2 when the kick back compensation signal KB is a high level in the second precharge time PC2. Accordingly, a current flow from the second gate line GL2 to the gate signal generating part 310 is cut off by the first diode DI1. Thus, the voltage drop of the second compensated gate signal GSC2 applied to the second gate line GL2 is prevented when the kick back compensation signal KB is a high level in the second precharge time PC2.

In contrast, the second gate line GL2 is directly connected to the gate signal generating part 310 when the kick back compensation signal KB is a high level in the second normal charge time NC2. Accordingly, a current flow from the second gate line GL2 to the gate signal generating part 310 is not cut off by the first diode DI1. Thus, the voltage drop of the second compensated gate signal GSC2 applied to the second gate line GL2 is allowed when the kick back compensation signal KB is a high level in the second normal time NC2.

According to the present exemplary embodiment, the power voltage generator 600 generates the compensated gate on voltage VONC by applying the charge sharing to the gate on voltage VON so that the kick back voltage may decrease and the display quality of the display panel 100 may be improved.

In addition, the switching part 320 prevents a voltage drop of the compensated gate on voltage VONC from being applied to the compensated gate signal GSC1, GSC2, GSC3, GSC4 and GSC5 in the precharge time PC1, PC2, PC3, PC4 and PC5 and allows the voltage drop of the compensated gate on voltage VONC to be applied to the compensated gate signal GSC1, GSC2, GSC3, GSC4 and GSC5 in the normal charge time NC1, NC2, NC3, NC4 and NC5 so that the charging rate of the pixel voltage may be improved and the power consumption may be reduced.

According to the present inventive concept as explained above, the power voltage generator generates the compensated gate on voltage so that the kick back voltage may decrease and the display quality may be improved. The gate driver selectively applies the voltage drop of the compensated gate on voltage in the precharge time and in the normal charge time so that the charging rate of the pixel voltage may be improved and the power consumption may be reduced.

The foregoing is illustrative of the present inventive concept and is not to be construed as limiting the scope of the inventive concept. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A gate driver comprising:

a gate signal generating part configured to generate a gate signal including a precharge time and a normal charge time using a compensated gate on voltage and a gate off voltage;

a switching part disposed between the gate signal generating part and a gate line and configured to apply a compensated gate signal to the gate line; and a switching controlling part configured to generate a switching control signal for controlling an operation of the switching part, wherein the switching part comprises a first switch and a first diode connected in parallel between the gate signal generating part and the gate line, wherein the switching control signal is generated using a previous gate clock signal corresponding to a previous gate line, a present gate clock signal corresponding to a present gate line and a kick back compensation signal, and wherein the switching controlling part comprises AND gate configured to receive the previous gate clock signal, the present gate clock signal and the kick back compensation signal.

2. The gate driver of claim 1, wherein the switching part is configured to prevent a voltage drop of the compensated gate on voltage from being applied to the compensated gate signal in the precharge time, and the switching part is configured to allow the voltage drop of the compensated gate on voltage to be applied to the compensated gate signal in the normal charge time.

3. The gate driver of claim 1, wherein the compensated gate on voltage has a gate on voltage level which is a DC voltage and gradually decreases from the gate on voltage level corresponding to the kick back compensation signal.

* * * * *